US009911301B1

(12) United States Patent
Foley

(10) Patent No.: US 9,911,301 B1
(45) Date of Patent: Mar. 6, 2018

(54) LOST CHILD NOTIFICATION SYSTEM

(71) Applicant: Luisa Foley, Winthrop, MA (US)

(72) Inventor: Luisa Foley, Winthrop, MA (US)

( * ) Notice: Subject to any disclaimer, the term of this patent is extended or adjusted under 35 U.S.C. 154(b) by 0 days.

(21) Appl. No.: 15/426,385

(22) Filed: Feb. 7, 2017

(51) Int. Cl.
*G08B 21/02* (2006.01)

(52) U.S. Cl.
CPC ..... *G08B 21/0275* (2013.01); *G08B 21/0261* (2013.01); *G08B 21/0288* (2013.01)

(58) Field of Classification Search
CPC ..... G07C 9/00111; G08B 13/1427; G08B 21/0275; G08B 21/22; G08B 21/0269; G08B 21/0227; G08B 21/0247; G08B 21/0288; G08B 13/2417; G08B 21/0277; G08B 21/0446; G08B 13/2431; G08B 21/0272; G08B 21/0291; G08B 21/0415; G08B 21/088; G08B 25/10; H04W 4/021; H04W 4/008; G06Q 50/24; H04M 1/7253; G01V 15/00; G01V 8/16
See application file for complete search history.

(56) References Cited

U.S. PATENT DOCUMENTS 4,736,196 A 4/1988 McMahon
5,396,218 A * 3/1995 Olah ..... G08B 13/1427 340/539.1
6,084,513 A * 7/2000 Stoffer ..... G08B 13/2417 340/572.1
6,195,009 B1 2/2001 Irizarry
6,472,989 B2 10/2002 Frederick
7,164,354 B1 1/2007 Panzer
7,802,724 B1 * 9/2010 Nohr ..... G07C 9/00111 235/384
9,207,303 B2 * 12/2015 Beidel ..... G01S 5/00
D753,314 S 4/2016 Stivoric
9,366,746 B2 * 6/2016 Kazerouni ..... G08B 13/1427
9,715,819 B1 * 7/2017 Stockdale ..... G08B 25/016
9,721,445 B2 * 8/2017 Hatch ..... G08B 21/0261
2004/0080420 A1 4/2004 Roberts
2005/0052275 A1 3/2005 Houle
2007/0023496 A1 * 2/2007 Hall ..... G07C 9/00111 235/375

(Continued)

FOREIGN PATENT DOCUMENTS

WO 2005025278 A1 3/2005

*Primary Examiner* — Fekadeselassie Girma

(57) ABSTRACT

The lost child notification system is a transponder based alarm system that monitors the position of a tracked person relative to an appropriate authority who should be in the vicinity of the person. The lost child notification system comprises a supervisory bracelet and a tracking bracelet. The supervisory bracelet is a finding that is worn or carried by the appropriate authority. The tracking bracelet is worn or carried by the tracked person. The supervisory bracelet sends out a first electromagnetic signal that stimulates the tracking bracelet to respond to the supervisory bracelet with a second electromagnetic signal. If the supervisory bracelet does not detect the second electromagnetic signal, the supervisory bracelet generates an alarm. The tracking bracelet further detects whether the security of the tracking bracelet has been compromised. If the tracking bracelet has been compromised, the tracking bracelet generates the second electromagnetic signal.

6 Claims, 5 Drawing Sheets

(56) References Cited

U.S. PATENT DOCUMENTS

2008/0015903 A1* 1/2008 Rodgers ..... G06F 19/327 705/3
2008/0021731 A1* 1/2008 Rodgers ..... A61B 5/1113 705/2
2009/0085873 A1* 4/2009 Betts ..... G08B 13/1427 345/169
2009/0128300 A1* 5/2009 Lake ..... G08B 13/1427 340/10.3
2010/0231378 A1* 9/2010 Ward ..... A61B 5/0402 340/539.11
2011/0169633 A1* 7/2011 Lauder ..... G01S 3/80 340/539.13
2011/0232585 A1* 9/2011 Rich ..... A01K 15/023 119/721
2012/0223834 A1* 9/2012 Hyatt ..... G08B 21/0247 340/539.13
2012/0302169 A1* 11/2012 Lin ..... G06F 3/023 455/41.3
2013/0092098 A1* 4/2013 Dutcher ..... A01K 15/04 119/721
2014/0210616 A1* 7/2014 Ramachandran .. G08B 21/0227 340/539.13
2014/0240088 A1* 8/2014 Robinette ..... G08B 13/1427 340/5.61
2014/0266707 A1* 9/2014 Melton ..... G08B 21/22 340/539.13
2015/0035672 A1* 2/2015 Housley ..... G08B 21/0275 340/539.13
2015/0080181 A1* 3/2015 Skulman ..... A63B 24/0075 482/3
2015/0126234 A1* 5/2015 Rodriguez ..... G08B 13/22 455/457
2015/0131085 A1* 5/2015 Cooper ..... G01V 8/16 356/213
2015/0213225 A1* 7/2015 Amarasingham ... G06F 19/3431 705/2
2016/0012700 A1* 1/2016 Matko ..... G08B 21/086 340/573.6
2016/0021535 A1* 1/2016 Tali ..... H04W 68/00 455/411
2016/0150362 A1* 5/2016 Shaprio ..... H04W 4/02 340/539.13
2017/0124850 A1* 5/2017 Kramer ..... G08B 21/245
2017/0178483 A1* 6/2017 Shapiro ..... G08B 21/0266
2017/0196774 A1* 7/2017 Ohl ..... A61J 7/0481
2017/0212769 A1* 7/2017 Yang ..... G06F 9/4406
2017/0246331 A1* 8/2017 Lloyd ..... A61L 2/084
2017/0270323 A1* 9/2017 Butler ..... H04L 67/1097

* cited by examiner

LOST CHILD NOTIFICATION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of instruments including calling and signaling systems, more specifically, a transponder based alarm system that is adapted to ensure the safety of a person.

SUMMARY OF INVENTION

The lost child notification system is a transponder based alarm system that monitors the position of a tracked person relative to an appropriate authority who should be in the vicinity of the person. The lost child notification system comprises a supervisory bracelet and a tracking bracelet. The supervisory bracelet is a finding that is worn or carried by the appropriate authority. The tracking bracelet is worn or carried by the tracked person. The supervisory bracelet sends out a first electromagnetic signal that stimulates the tracking bracelet to respond to the supervisory bracelet with a second electromagnetic signal. If the supervisory bracelet does not detect the second electromagnetic signal, the supervisory bracelet generates an alarm to inform the appropriate authority that the location of the tracked person needs to be determined. The tracking bracelet further detects whether the security of the tracking bracelet has been compromised. If the tracking bracelet has been compromised, the tracking bracelet generates the second electromagnetic signal.

These together with additional objects, features and advantages of the lost child notification system will be readily apparent to those of ordinary skill in the art upon reading the following detailed description of the presently preferred, but nonetheless illustrative, embodiments when taken in conjunction with the accompanying drawings.

In this respect, before explaining the current embodiments of the lost child notification system in detail, it is to be understood that the lost child notification system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lost child notification system.

It is therefore important that the claims be regarded as including such equivalent construction insofar as they do not depart from the spirit and scope of the lost child notification system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
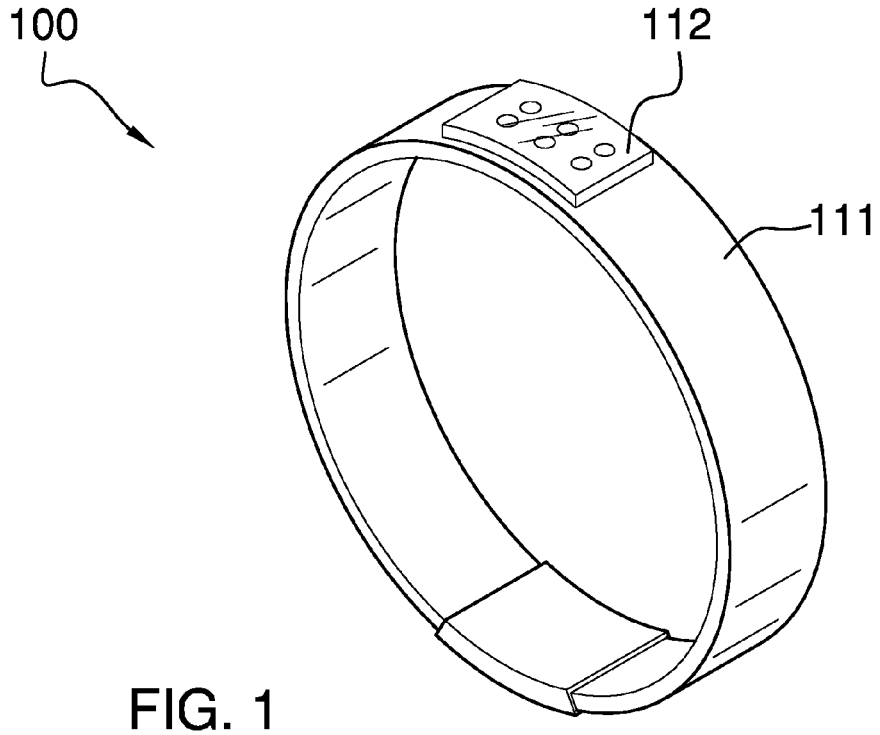
FIG. 1 is a perspective view of an embodiment of the disclosure.
Figure 2:
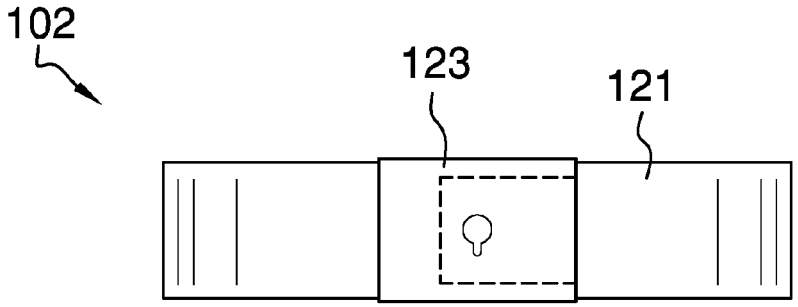
FIG. 2 is a bottom view of an embodiment of the disclosure.
Figure 3:
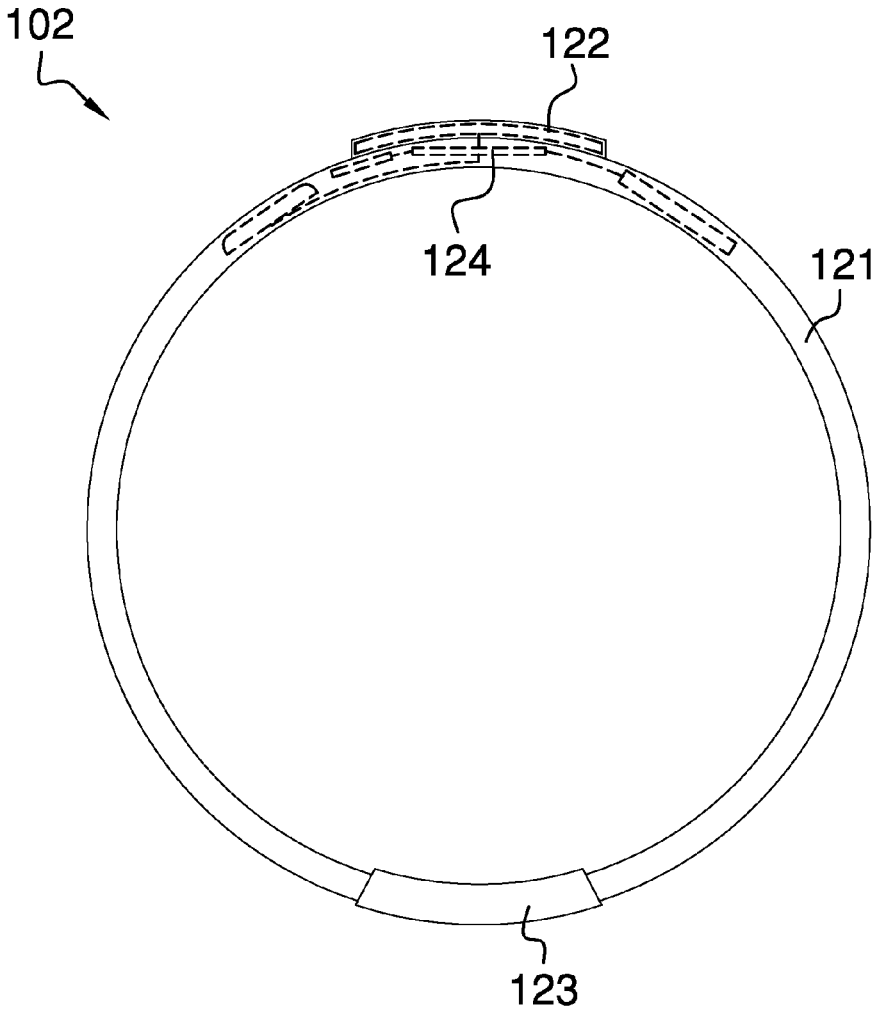
FIG. 3 is a front view of an embodiment of the disclosure.
Figure 4:
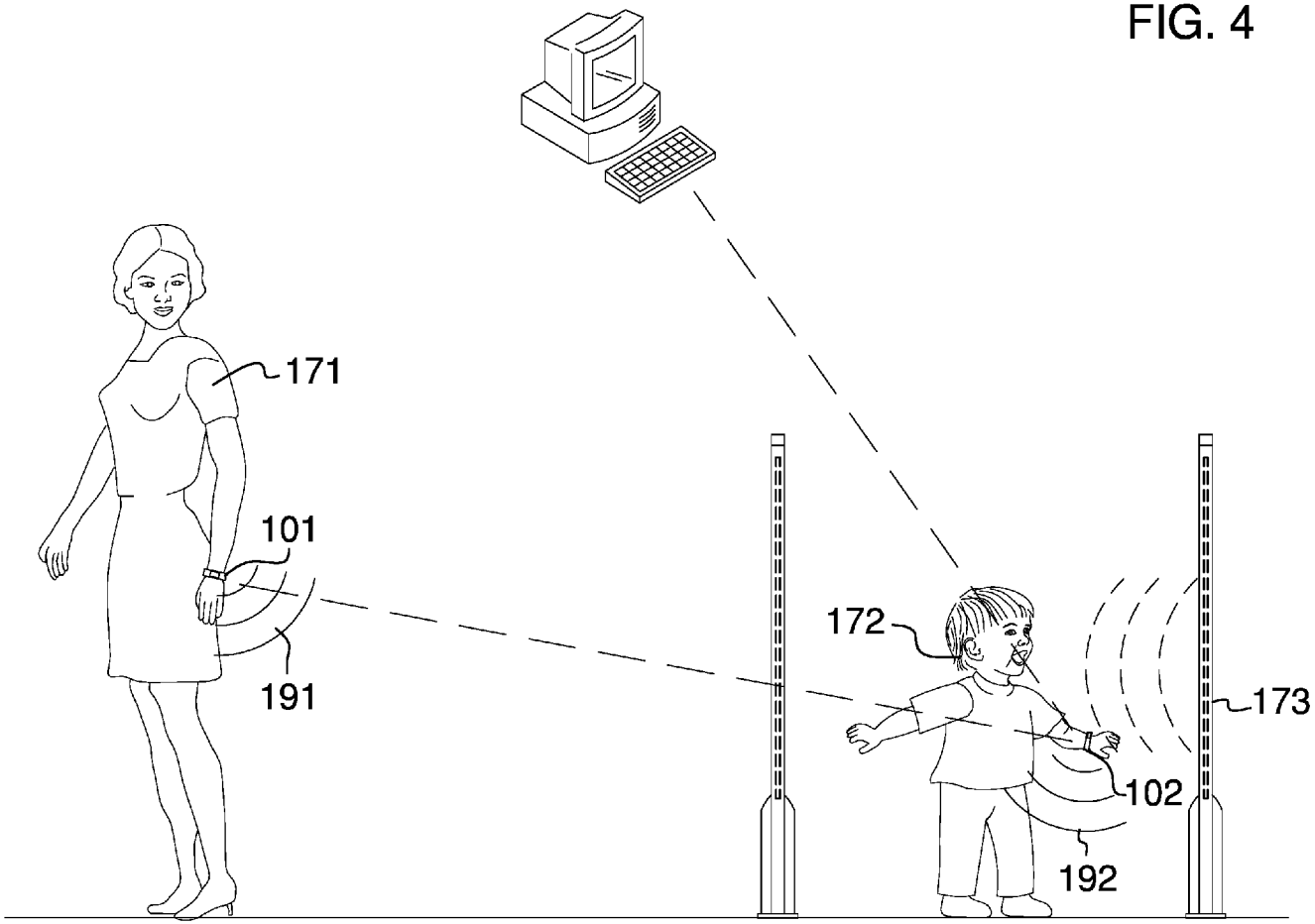
FIG. 4 is an in use view of an embodiment of the disclosure.
Figure 5:
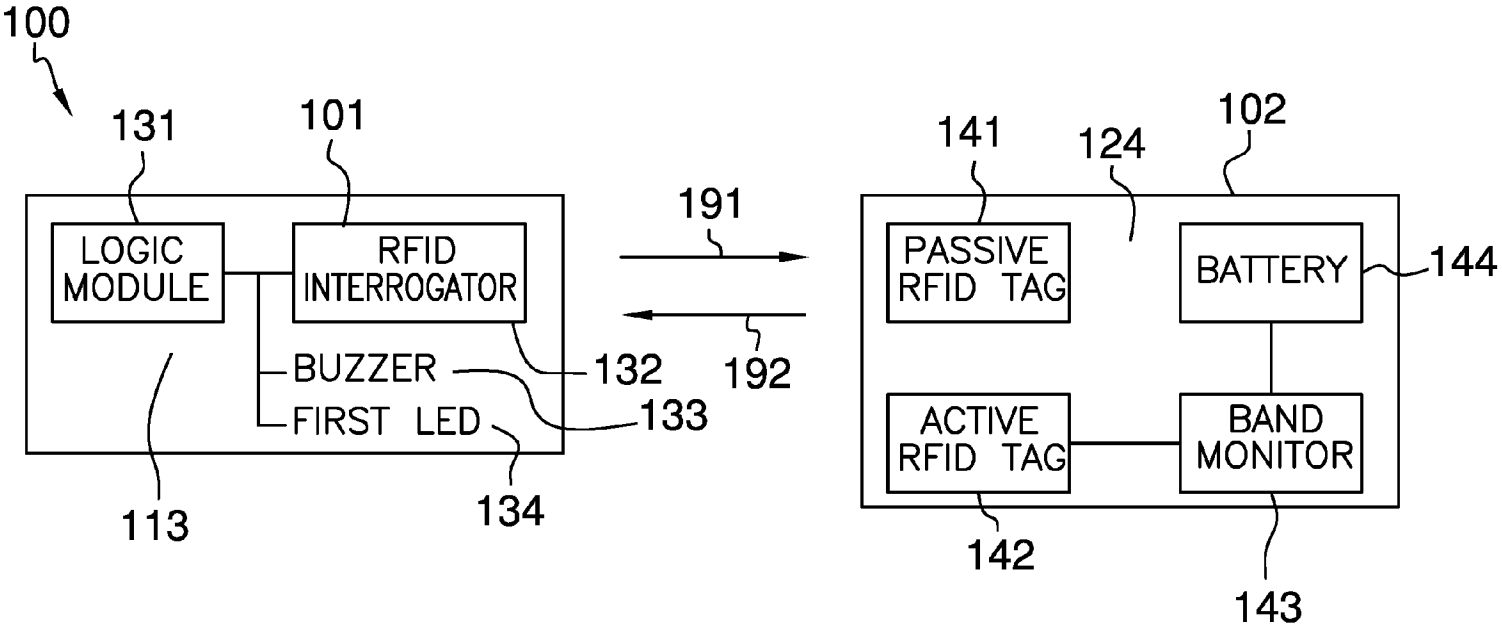
FIG. 5 is a block diagram of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The lost child notification system 100 (hereinafter invention) is a transponder based alarm system that monitors the position of a tracked person 172 relative to an appropriate authority 171 who should be in the vicinity of the person. The invention 100 comprises a supervisory bracelet 101 and a tracking bracelet 102. The supervisory bracelet 101 is a finding that is worn or carried by the appropriate authority 171.

The appropriate authority 171 refers to a person who is designated to wear the supervisory bracelet 101. The tracking bracelet 102 is worn or carried by the tracked person 172. The tracked person 172 refers to a person who is designated to wear the tracking bracelet 102. The supervisory bracelet 101 sends out a first electromagnetic signal 191 that stimulates the tracking bracelet 102 to respond to the supervisory bracelet 101 with a second electromagnetic signal 192. The first electromagnetic signal 191 refers to radio signals sent in the direction from the supervisory bracelet 101 to the tracking bracelet 102. The second electromagnetic signal 192 refers to radio signals sent in the direction from the tracking bracelet 102 to the supervisory bracelet 101. If the supervisory bracelet 101 does not detect the second electromagnetic signal 192, the supervisory bracelet 101 generates an alarm that informs the appropriate authority 171 that the location of the tracked person 172 needs to be determined. The tracking bracelet 102 further detects whether the security of the tracking bracelet 102 has been compromised. If the tracking bracelet 102 has been compromised, the tracking bracelet 102 generates the second electromagnetic signal 192, which is received by the supervisory bracelet 101 which in turn generates an alarm.

The tracking bracelet 102 is further designed to trigger a retail location RFID interrogator 173 in such a manner that an alarm maintained by the retail location (to prevent shoplifting) will be triggered should the tracked person 172 attempt to leave the retail location using one of the retail location's monitored exits. The retail location RFID interrogator 173 refers to an RFID interrogator that is placed at the entrances and exits of a retail location.

The supervisory bracelet 101 is a finding that is worn or carried by the appropriate authority 171. The communication status between the supervisory bracelet 101 and the tracking bracelet 102 is used by the supervisory bracelet 101 to determine the security status of the tracked person 172. The supervisory bracelet 101 comprises a first band 111, a first housing 112, and a beacon circuit 113.

The first band 111 is a strap that is formed into a loop. The first band 111 is looped around a limb associated with the appropriate authority 171. The first housing 112 is a first casing that is attached to the first band 111. The first housing 112 contains the beacon circuit 113.

The beacon circuit 113 is a first electrical apparatus that communicates with the responding circuit 124 of the tracking bracelet 102 for the purpose of determining the security status of the tracked person 172. The beacon circuit 113 comprises a logic module 131, a first RFID interrogator 132, a buzzer 133, and a first LED 134.

The logic module 131 is a readily and commercially available programmable electronic device that is used to manage, regulate, and operate the beacon circuit 113. The first RFID interrogator 132 is a readily and commercially available RFID interrogator or interrogation circuit. The first RFID interrogator 132 transmits a radio signal that will: 1) cause the passive RFID tag 141 to generate an RFID response that is received by the first RFID interrogator 132; and, 2) receives a second electromagnetic signal 192 that is generated from the group consisting of the passive RFID tag 141 or the active RFID tag 142. The first RFID interrogator 132 passes the second electromagnetic signal 192 to the logic module 131 for further processing. Methods to integrate passive and active RFID tracking tags with RFID interrogators and associated data processing equipment are well known and documented in the electrical arts.

The buzzer 133 is a readily and commercially available electrical device that, when electrically activated, will: 1) generate an audible sound; and, 2) generate a vibration. The buzzer 133 is mounted in the first housing 112 such that the appropriate authority 171 will hear the audible sound and feel the vibration generated by the buzzer 133. The first LED 134 is a readily and commercially available light producing device. The first LED 134 is mounted in the first housing 112 such that the appropriate authority 171 will see the light produced by the first LED 134.

The tracking bracelet 102 is a finding that is worn or carried by the tracked person 172. In the first potential embodiment of the disclosure, the tracking bracelet 102 and the supervisory bracelet 101 are bracelets. The tracking bracelet 102 comprises a second band 121, a second housing 122, a locking clasp 123, and a responding circuit 124.

The second band 121 is a second strap that is formed into a loop. The second band 121 is looped around a limb associated with the tracked person 172. The second housing 122 is a second casing that is attached to the second band 121. The second housing 122 contains the responding circuit 124.

The locking clasp 123 is a locking device. The locking clasp 123 is designed with a locking mechanism that ensures that only the appropriate authority 171 is able to release the locking clasp 123 and thereby detach the tracking bracelet 102. The locking clasp 123 is a two element fastener. The locking clasp 123 attaches and detaches the two ends of the second band 121 in order to put on and take off the tracking bracelet 102. The locking clasp 123 comprises a primary fastener 151 and a continuity connection 152. The primary fastener 151 comprises a first element 153 and a second element 154. The continuity connection 152 comprises a first connector 155 and a second connector 156.

The primary fastener 151 is a mechanical device that is used to physically lock the second band 121 around the limb of a tracked person 172. The first element 153 is a first fastening element of the primary fastener 151. The first element 153 attaches to the second element 154 to form the loop of the second band 121. The second element 154 is a second fastening element of the primary fastener 151. The second element 154 attaches to the first element 153 to form the loop of the second band 121.

The continuity connection 152 is a circuit that is used to monitor the status of the second band 121. The continuity connection 152 is selected from the group consisting of an electrical circuit or a photoelectric circuit. The first connector 155 is a first terminating element associated with the continuity connection 152. The first connector 155 connects to the second connector 156 in a manner that completes the circuit supported by the continuity connection 152. The second connector 156 is a second terminating element associated with the continuity connection 152. The second connector 156 connects to the first connector 155 in a manner that completes the circuit supported by the continuity connection 152.

The first connector 155 is attached to the first element 153 of the primary fastener 151. The second connector 156 is attached to the second element 154 of the primary fastener 151. The first connector 155 and the second connector 156 are attached to the primary fastener 151 such that when the first element 153 attaches to the second element 154 the first connector 155 connects to the second connector 156 in such a manner that the continuity connection 152 completes the band monitor 143 circuit.

Methods to form the continuity connection 152 and to integrate such a connection into a fastener are well known and documented in the electrical and mechanical arts.

The responding circuit 124 is a second electrical apparatus that communicates with the beacon circuit 113 of the supervisory bracelet 101 for the purpose of determining and communicating the security status of the tracked person 172. The responding circuit 124 comprises a passive RFID tag 141, an active RFID tag 142, a band monitor 143, and a battery 144. The battery 144 is a readily and commercially available battery that is used to power the responding circuit 124.

The passive RFID tag 141 is an unpowered RFID device that reflects radio signals generated by the first RFID interrogator 132 in a manner that allows the first RFID interrogator 132 (or any other compatible RFID interrogator) to identify the passive RFID tag 141. If the first RFID interrogator 132 fails to receive a response from the passive RFID tag 141 the logic module 131 generates an alarm by activating the buzzer 133 and illuminating the first LED 134.

The passive RFID tag 141 is selected such that the passive RFID tag 141 will reflect signals generated by retail location RFID interrogator 173. The retail location RFID interrogator 173 detects the response of the passive RFID tag 141 to the interrogation signal generated by the retail location RFID interrogator 173. Upon detecting the response of the passive RFID tag 141 the retail location RFID interrogator 173 is designed to activate an alarm that will draw the attention of those within the retail location to the exit through which the tracked person 172 attempted to exit. Depending on the design, additional passive RFID tags 141 may be incorporated into the invention 100 to expand the types of retail location RFID interrogator 173 the invention 100 will operate with. By selecting the passive RFID tag 141 in this manner, an additional layer of security is provided. This additional security is particularly effective when the tracked person 172 is a child.

The active RFID tag 142 is a powered RFID device that transmits radio signals that are subsequently received by the first RFID interrogator 132 in a manner that allows the first RFID interrogator 132 to identify the active RFID tag 142. The active RFID tag 142 is further defined with a first power lead 195 and a first ground lead 196. The first power lead 195 is an electrical connection of the active RFID tag 142 that is used to attach the active RFID tag 142 to a power source. The first ground lead 196 is an electrical connection of the active RFID tag 142 that is used to attach the active RFID tag 142 to the electrical ground 189.

The band monitor 143 monitors the continuity connection 152. If the band monitor 143 detects a disruption in the continuity connection 152 the active RFID tag 142 is activated by the band monitor 143. The band monitor 143 is an electrical circuit that is incorporated into the responding circuit 124. The band monitor 143 is a sensor that detects tampering with the second band 121 by unauthorized persons. The band monitor 143 comprises a phototransistor 161, a second LED 162, a limit resistor 163, a fiber optic cable 164, and a limit resistor 165. In the first potential embodiment of the disclosure, the fiber optic cable 164 forms the continuity connection 152.

The operating presumption of the supervisory bracelet 101 is that the activation of the active RFID tag 142 was caused by either: 1) a cut in the fiber optic cable 164 caused when the second band 121 was cut; or, 2) that the locking clasp 123 was disconnected. In either case, the event is assumed to be an effort to inappropriately remove the tracking bracelet 102 from the tracked person 172. Upon receipt of a second electromagnetic signal 192 from the active RFID tag 142, the logic module 131 will initiate an alarm by activating the buzzer 133 and illuminating the first LED 134.

The phototransistor 161 is a readily and commercially available photoelectrically operated version of a transistor. Specifically, a phototransistor 161 replaces the function of the electric current flowing through the base of a transistor with electromagnetic radiation, such as photons in the visible light range, in order to operate the transistor. The second LED 162 is a readily and commercially available light producing device. The second LED 162 is generates the electromagnetic radiation that operates the phototransistor 161. The fiber optic cable 164 is a commercially available device. The fiber optic cable 164 is used to guide the light generated by the second LED 162 to the phototransistor 161.

The pull up resistor 165 is a readily and commercially available resistor. The purpose of the pull up resistor 165 is to limit current flow through the phototransistor 161. The limit resistor 163 is a readily and commercially available resistor. The purpose of the limit resistor 163 is to limit current flow through the second LED 162.

The phototransistor 161 is further defined with a phototransistor collector 187 and a phototransistor emitter 188. The second LED 162 is further defined with an LED anode 185 and an LED cathode 186. The limit resistor 163 is further defined with a first lead 181 and a second lead 182. The pull up resistor 165 is further defined with a third lead 193 and a fourth lead 194. The battery 144 is further defined with a battery cathode 183 and a battery anode 184.

The battery cathode 183 refers to the positive connection of battery 144 while the battery 144 is in a discharge mode. The battery anode 184 refers to the negative connection of battery 144 while the battery 144 is in a discharge mode. The LED anode 185 refers to the positive connection of second LED 162 when the second LED 162 is illuminated. The LED cathode 186 refers to the negative connection of second LED 162 when the second LED 162 is illuminated. The phototransistor collector 187 is an electrical connection of the phototransistor 161. The phototransistor emitter 188 is an electrical connection of the phototransistor 161. The electrical ground 189 is a voltage reference that is used throughout the band monitor 143 circuit.

Figure 6:
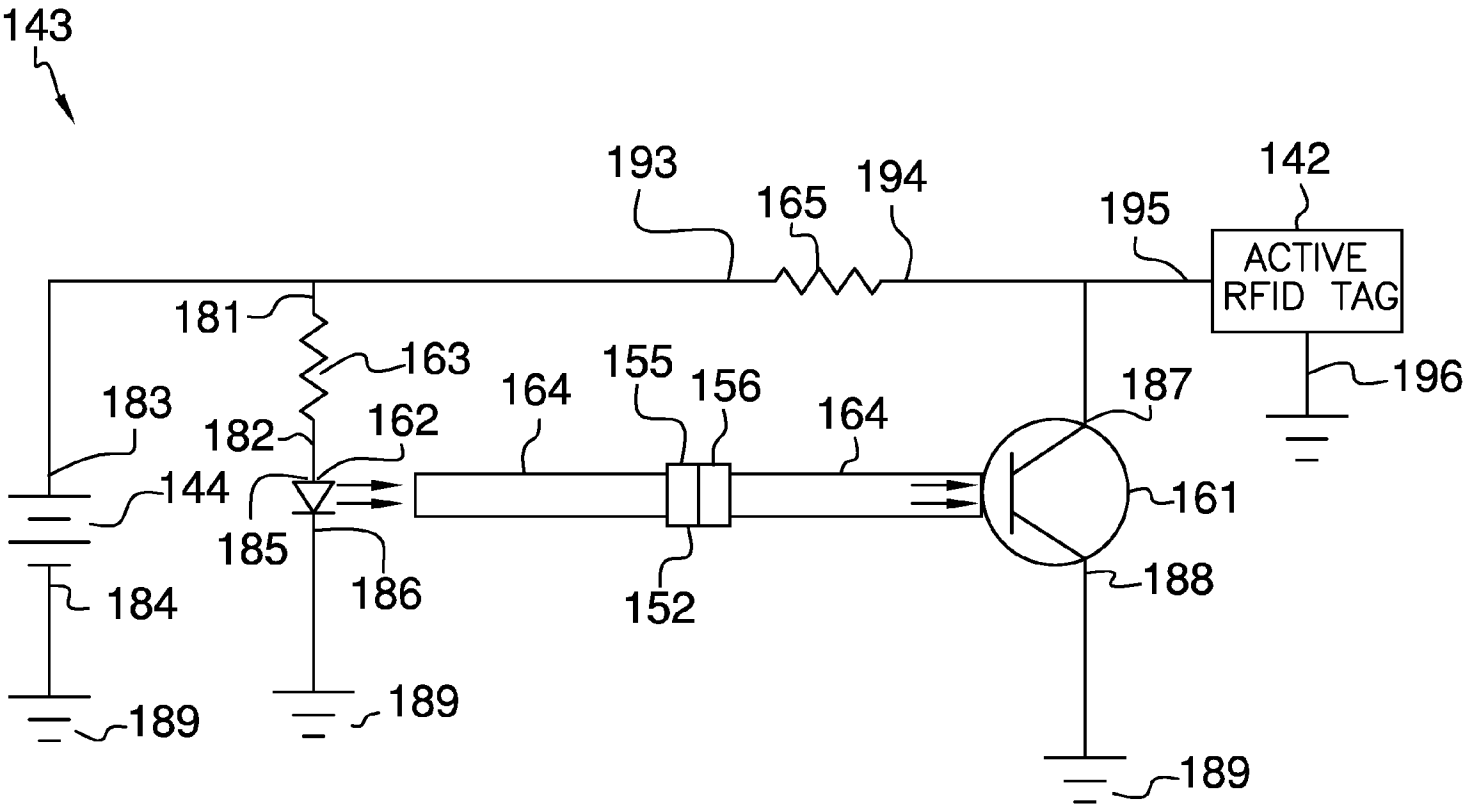
FIG. 6 is a detail view of an embodiment of the disclosure.

As shown most clearly in FIG. 6, the band monitor 143 is assembled and operates as described in the next four paragraphs.

The battery cathode 183 of the battery 144 electrically connects to the first lead 181 of the limit resistor 163. The battery cathode 183 of the battery 144 electrically connects to the third lead 193 of the pull up resistor 165. The second lead 182 of the limit resistor 163 electrically connects to the LED anode 185 of the second LED 162. The fourth lead 194 of the pull up resistor 165 electrically connects to the phototransistor collector 187 of the phototransistor 161. The fourth lead 194 of the pull up resistor 165 electrically connects to the first power lead 195 of the active RFID tag 142. The battery anode 184 of the battery 144 electrically connects to the electrical ground 189. The LED cathode 186 of the second LED 162 electrically connects to the electrical ground 189. The phototransistor emitter 188 of the phototransistor 161 electrically connects to the electrical ground 189. The first ground lead 196 of the active RFID tag 142 electrically connects to the electrical ground 189. The second LED 162 is positioned such that the light generated from the second LED 162 is transmitted into and through the fiber optic cable 164.

The first connector 155 of the continuity connection 152 attaches to the second connector 156 of the continuity connection 152 in order to allow light to pass from the second LED 162 to the phototransistor 161 over the fiber optic cable 164. This connection is discussed in detail elsewhere in this disclosure. The phototransistor 161 is positioned such that the light generated from the second LED 162 and transmitted through the fiber optic cable 164 falls on the phototransistor 161 in such a manner that the transmitted light will fall on the base region of the phototransistor 161.

When the transmitted light falls upon the phototransistor 161, the phototransistor 161 acts like a closed switch that completes an electrical connection between the pull up resistor 165 and the electrical ground 189 such that the power supply of the active RFID tag 142 is effectively shorted out. In this scenario, current flow through the band monitor 143 is limited by the pull up resistor 165.

Should the transmitted light fail to fall on the phototransistor 161 the phototransistor 161 acts as an open switch which, as shown most clearly in FIG. 6, redirects current flow from the battery 144 and the pull up resistor 165 to the active RFID tag 142. This application of power to the active RFID tag 142 activates the active RFID tag 142 which then transmits a second electromagnetic signal 192 that is detected by the first RFID interrogator 132 of the beacon circuit 113.

The Following Definitions were Used in this Disclosure

Anodes and Cathodes: As used in this disclosure, an anode and a cathode are the connecting terminals of an electrical circuit element or device. Technically, the cathode is the terminal through which the physical electrons flow into the device. The anode is the terminal through which the physical electrons flow out of the device. As a practical matter the anode refers to: 1) the positive terminal of a power consuming electrical circuit element; 2) the negative terminal of a discharging battery or an electrical power source; and, 3) the positive terminal of a charging battery. As a further practical matter the cathode refers to: 1) the negative terminal of a power consuming electrical circuit element; 2) the positive terminal of a discharging battery or an electrical power source; and, 3) the negative terminal of a charging battery.

Appropriate Authority: As used in this disclosure, an appropriate authority is person or organization that is designated to receive alarm or other notification messages regarding a monitored system or activity.

Band: As used in this disclosure, a band is a flat loop of material.

Battery: As used in this disclosure, a battery is a container consisting of one or more cells, in which chemical energy is converted into electricity and used as a source of power.

Buzzer: As used in this disclosure, a buzzer is two lead electrical device that generates an audible sound when voltage is applied to the two leads.

Diode: As used in this disclosure, a diode is a two terminal semiconductor device that allows current flow in only one direction. The two terminals are called the anode and the cathode. Electric current is allowed to pass from the anode to the cathode.

Electrical Ground: As used in this disclosure, an electrical ground is a common reference voltage that is used in the design and implementation of electrical circuits. An electrical ground is often, but not necessarily, the discharge point of electric currents flowing through an electric circuit.

Fastener: As used in this disclosure, a fastener is a device that is used to join or affix two objects. Fasteners generally comprise a first element which is attached to the first object and a second element which is attached to the second object such that the first element and the second element join to affix the first object and the second object.

Findings: As used in this disclosure, findings are small decorative elements, fasteners, or tools for fit, function, or adjustment that are used with apparel or footwear.

LED: As used in this disclosure, an LED is an acronym for a light emitting diode. A light emitting diode is a diode that is also a light source.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

RFID: As used in this disclosure, RFID refers to Radio Frequency Identification technology. RFID is a wireless technology that uses electromagnetic field to identify and retrieve data from tracking tags that are placed on an object.

RFID Interrogator: As used in this disclosure, an RFID interrogator is a device that transmits a radio signal at frequency designed to activate RFID tracking tags that are tuned to operate at that frequency.

RFID Tracking Tag: As used in this disclosure, an RFID tracking tag is a reflective antenna that receives a radio signal from an RFID Interrogator and uses the energy received from the RFID interrogator signal to reflect a modified signal back to the RFID interrogator. The modified signal generally contains identification information about the RFID tag. The RFID interrogator receives and records these reflected signals. RFID tags are generally tuned to respond to a specific frequency. The RFID tracking tag as described to this point is a passive, or unpowered RFID tracking tag. There are also available within RFID technology active, or powered, RFID tracking tags. An active RFID tracking tag acts as a beacon that actively transmits identification information in a manner that can be received and recorded by an RFID interrogator. Within this disclosure, both passive and active RFID tracking tags are used.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Transistor: As used in this disclosure, a transistor is a general term for a three terminal semiconducting electrical that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal.

Transponder: As used in this disclosure, a transponder is a device designed to receive a radio signal and automatically transmit a different radio signal. In this disclosure, RFID tracking tags will be referred to as transponders.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A transponder based alarm system:

wherein the transponder based alarm system monitors the position of a tracked person relative to an appropriate authority;

wherein the transponder based alarm system comprises a supervisory bracelet and a tracking bracelet;

wherein the supervisory bracelet is a finding that is carried by the appropriate authority;

wherein the tracking bracelet is a finding that is carried by the tracked person;

wherein the supervisory bracelet transmits a first electromagnetic signal;

wherein the tracking bracelet transmits a second electromagnetic signal;

wherein the supervisory bracelet does generates an alarm;

wherein the tracking bracelet further detects whether the security of the tracking bracelet has been compromised;

wherein the transponder is further configured to work with a retail location RFID interrogator;

wherein the retail location RFID interrogator refers to an RFID interrogator that is placed at the entrances and exits of a retail location;

wherein the tracking bracelet trigger a retail location RFID interrogator in such a manner that an alarm maintained by the retail location is triggered should the tracked person attempt to leave the retail location using one of the retail location's monitored exits;

wherein the supervisory bracelet comprises a first band, a first housing, and a beacon circuit;

wherein the first band is a strap that is formed into a loop;

wherein the first band is looped around a limb associated with the appropriate authority;

wherein the first housing is a first casing that is attached to the first band;

wherein the first housing contains the beacon circuit;

wherein the beacon circuit is a first electrical apparatus;

wherein the beacon circuit comprises a logic module, a first RFID interrogator, a buzzer, and a first LED;

wherein the first RFID interrogator, the buzzer, and the first LED are electrically connected to the logic module;

wherein the logic module is a programmable electronic device that operates the beacon circuit;

wherein the first RFID interrogator is a RFID interrogator;

wherein the buzzer is an electrical device that, when electrically activated generates an audible sound a vibration;

wherein the first LED is light producing device;

wherein the first LED is mounted in the first housing such that the appropriate authority will see the light produced by the first LED;

wherein the first RFID interrogator transmits a radio signal that causes the responding circuit to generate the second electromagnetic signal;

wherein the first RFID interrogator receives the second electromagnetic signal;

wherein the first RFID interrogator passes the second electromagnetic signal to the logic module for processing;

wherein the tracking bracelet comprises a second band, a second housing, a locking clasp, and a responding circuit;

wherein the second band is a second strap that is formed into a loop;

wherein the second housing is a second casing that is attached to the second band;

wherein the second housing contains the responding circuit;

wherein the locking clasp is a locking device;

wherein the locking clasp is attached to the second band;

wherein the locking clasp comprises a locking mechanism;

wherein the locking clasp comprises a primary fastener and a continuity connection;

wherein the terminations of the continuity connection are attached to the primary fastener;

wherein the primary fastener is a mechanical device that is used to physically lock the second band around the limb of a tracked person;

wherein the primary fastener comprises a first element and a second element;

wherein the first element is a first fastening element of the primary fastener;

wherein the second element is a second fastening element of the primary fastener;

wherein the first element attaches to the second element to form the loop of the second band;

wherein the continuity connection is a circuit that is used to monitor the status of the second band;

wherein the continuity connection is selected from the group consisting of an electrical circuit or a photoelectric circuit;

wherein the continuity connection comprises a first connector and a second connector;

wherein the first connector is a first terminating element associated with the continuity connection;

wherein the second connector is a second terminating element associated with the continuity connection;

wherein the first connector connects to the second connector in a manner that completes the circuit supported by the continuity connection;

wherein the first connector is attached to the first element of the primary fastener;

wherein the second connector is attached to the second element of the primary fastener;

wherein the responding circuit is a second electrical apparatus;

wherein the responding circuit comprises a passive RFID tag, an active RFID tag, a band monitor, and a battery;

wherein the battery powers the responding circuit;

wherein the active RFID tag and the battery are attached to the battery;

wherein the passive RFID tag is a standalone device that is contained within the second housing;

wherein the passive RFID tag is an unpowered RFID device that reflects radio signals generated by the first RFID interrogator in a manner that allows the first RFID interrogator (or any other compatible RFID interrogator) to identify the passive RFID tag;

wherein if the first RFID interrogator fails to receive a response from the passive RFID tag the logic module generates an alarm by activating the buzzer and illuminating the first LED;

wherein the active RFID tag is a powered RFID device that transmits radio signals that are subsequently received by the first RFID interrogator in a manner that allows the first RFID interrogator to identify the active RFID tag;

wherein the active RFID tag is further defined with a first power lead and a first ground lead;

wherein the first power lead is an electrical connection of the active RFID tag that is used to attach the active RFID tag to a power source;

wherein the first ground lead is an electrical connection of the active RFID tag that is used to attach the active RFID tag to an electrical ground;

wherein the electrical ground is a voltage reference that is used throughout the band monitor circuit;

wherein the band monitor detects a disruption in the continuity connection;

wherein if the band monitor detects a disruption in the continuity connection the active RFID tag is activated by the band monitor;

wherein the band monitor is an electrical circuit;

wherein the band monitor comprises a phototransistor, a second LED, a limit resistor, a pull up resistor, and a fiber optic cable;

wherein in the fiber optic cable forms the continuity connection;

wherein the phototransistor, the second LED, the limit resistor, and the pull up resistor are electrically interconnected;

wherein the second LED and the phototransistor are optically coupled;

wherein the second LED is generates the electromagnetic radiation that operates the phototransistor;

wherein upon failure of the optical coupling of the second LED and the phototransistor the active RFID tag transmits the second electromagnetic signal;

wherein upon receipt of the second electromagnetic signal from the active RFID, the logic module activates the buzzer and illuminates the first LED.

2. The transponder based alarm system according to claim 1 wherein the first connector and the second connector are attached to the primary fastener such that when the first element attaches to the second element the first connector connects to the second connector in such a manner that the continuity connection completes the band monitor circuit.

3. The transponder based alarm system according to claim 2 wherein the phototransistor is further defined with a phototransistor collector and a phototransistor emitter;

wherein the second LED is further defined with an LED anode and an LED cathode;

wherein the limit resistor is further defined with a first lead and a second lead;

wherein the pull up resistor is further defined with a third lead and a fourth lead;

wherein the battery is further defined with a battery cathode and a battery anode;

wherein the battery cathode of the battery electrically connects to the first lead of the limit resistor;

wherein the battery cathode of the battery electrically connects to the third lead of the pull up resistor;

wherein the second lead of the limit resistor electrically connects to the LED anode of the second LED;

wherein the fourth lead of the pull up resistor electrically connects to the phototransistor collector of the phototransistor;

wherein the fourth lead of the pull up resistor electrically connects to the first power lead of the active RFID tag;

wherein the battery anode of the battery electrically connects to the electrical ground;

wherein the LED cathode of the second LED electrically connects to the electrical ground;

wherein the phototransistor emitter of the phototransistor electrically connects to the electrical ground;

wherein the first ground lead of the active RFID tag electrically connects to the electrical ground.

4. The transponder based alarm system according to claim 2 wherein the second LED is positioned such that the light generated from the second LED is transmitted into and through the fiber optic cable;

wherein the first connector of the continuity connection attaches to the second connector of the continuity connection in order to allow light to pass from the second LED to the phototransistor over the fiber optic cable;

wherein the phototransistor is positioned such that the light generated from the second LED and transmitted through the fiber optic cable falls on the phototransistor in such a manner that the transmitted light will fall on the base region of the phototransistor;

wherein the phototransistor controls the application of power to the active RFID tag activates;

wherein the application of power to the active RFID tag initiates the transmission of the second electromagnetic signal.

5. The transponder based alarm system according to claim 4 wherein the passive RFID tag is reflects signals generated by retail location RFID interrogator.

6. The transponder based alarm system according to claim 1 wherein the tracking bracelet and the supervisory bracelet are bracelets.

* * * * *